US005557824A

United States Patent [19]

Bushey

[11] Patent Number: 5,557,824

[45] Date of Patent: Sep. 24, 1996

[54] FURNITURE FLOOR GLIDE

[76] Inventor: Richard D. Bushey, 3521 16th Ave., Kenosha, Wis. 53140

[21] Appl. No.: 494,696

[22] Filed: Jun. 26, 1995

[51] Int. Cl.[6] ..... A47B 91/06

[52] U.S. Cl. ..... 16/42 R

[58] Field of Search ..... 16/42 R, 42 T

[56] References Cited

U.S. PATENT DOCUMENTS

| | | | |
|---|---|---|---|
| 1,069,141 | 8/1913 | Jones . | |
| 1,982,138 | 11/1934 | Herold | 45/137 |
| 2,644,978 | 7/1953 | Becker | 16/42 T |
| 2,717,410 | 9/1955 | Holloman | 16/29 |
| 2,787,085 | 4/1957 | Auer | 45/137 |
| 2,886,918 | 5/1959 | Bayley et al. | 16/42 R |
| 2,996,753 | 8/1961 | Kramcsak, Jr. | 16/42 |
| 3,126,666 | 3/1964 | Petersen | 45/137 |
| 3,177,518 | 4/1965 | Bergstrom | 16/42 |
| 3,183,545 | 5/1965 | Bergstrom | 16/42 R |
| 3,326,508 | 6/1967 | Born | 248/346.1 |
| 3,623,184 | 11/1971 | Mazur | 16/42 R |
| 4,124,917 | 11/1978 | Gilliland | 16/42 R |
| 5,081,740 | 1/1992 | Smith | 16/42 R |
| 5,220,705 | 6/1993 | Bushey | 16/42 R |

*Primary Examiner*—M. Rachuba
*Assistant Examiner*—Donald M. Gurley
*Attorney, Agent, or Firm*—John C. Shepard

[57] ABSTRACT

A floor glide for furniture and the like includes a monobloc having a relatively arcuate convex lower surface for contact with the floor and a flat upper surface for supporting furniture, and adhesive means for securing the monobloc to the bottom of furniture. The monobloc is relatively thick and defines recesses for locating resilient adhesive pieces. The monobloc may have webs or ribs for structural rigidity defining one or more cavities in the upper surface to minimize material use. The glide permits furniture to be moved easily along the surface of a floor or floor covering.

18 Claims, 4 Drawing Sheets

FURNITURE FLOOR GLIDE

BACKGROUND OF THE INVENTION

1. Technical Field

This invention relates generally to hardware and, more particularly, to a floor glide for furniture.

2. Background Art

In the prior art, coasters and glides for furniture legs are quite common. Coasters, also known as caster cups or furniture shoes, are typically glass, plastic, or rubber disks which are placed under the leg bottom. The coasters usually have a flat bottom so as to rest flat on the floor. The coasters act as a buffer between the legs, which are usually, small and sharp-edged, and the floor and distribute the weight of the leg over a larger area. As a result, floors and floor coverings are protected against marring, scratches, marks, dents and the like.

Glides made from plastic, such as nylon and polyethylene, or rubber or steel are applied directly to the end of furniture legs, or on the bottom edges of sides of desks or dressers, or to the bottom surfaces of file cabinets or bookcases. Typically, glides are relatively small, the size of a chair leg, and have a flat bottom. They are attached by screws, threaded stems, nails, or by press fitting the glides around the outside of legs or within the open end of hollow legs. Coasters and glides found in the prior art are not easily attached and do not permit heavier furniture to be moved readily or easily.

SUMMARY OF THE INVENTION

The present invention is directed to overcoming one or more of the problems as set forth above.

According to the present invention, a glide providing easier movement of furniture on carpeted and bare floors includes a relatively thick monobloc having an arcuate lower surface and a flat upper surface and adhesive means for securing the monobloc to the bottom of furniture.

In an exemplary embodiment of the glide, the monobloc is triangularly-shaped for use in the corners of furniture pieces and separate pieces of adhesive are used adjacent the three corners of the monobloc to secure the glide to the furniture bottom.

In one exemplary embodiment of the invention, the lower surface of a triangularly-shaped glide is defined by a series of arcs extending from the bottom of the glide upwardly towards the peripheral edges of the glide. The thickest part of the glide, i.e., the lowermost portion, is located toward the right-angle corner of the glide and spaced from the long edge, whereby the corner of the furniture is more closely located over the glide's floor contact point.

A feature of the invention is that the adhesive is carried by resilient material positioned within recesses defined in the upper surface of the monobloc so that the adhesive material when pressed into the recesses secures the monobloc. The furniture rests on the flat upper surface of the monobloc and not on the adhesive material which is not completely crushed by the weight of the furniture.

To reduce material cost, a glide may be constructed with a single large cavity defined by a peripheral web. The glide may have a series interconnecting structural webs defining multiple small cavities. The webs surrounding the single or multiple cavities support the furniture and prevent the monobloc from deforming or flattening out.

A further feature of the invention is that the peripheral sides are defined by a relatively small radius arc providing a draft angle for mold release during injection molding and the remainder of the lower surface is primarily defined by large radius arcs providing a low friction contact surface for sliding movement along the floor.

In another embodiment of the invention, the lower surface of the glide has a relatively thin flat area between the arcs which extend to opposite peripheral edges.

An advantage of the invention is that the contact surface of the glide is smooth with no abrupt angles or edges since the lower surface has curves blended into one another. Thus, the glide does not "dig" into the floor or "plow" when furniture is moved along the floor. The glide disperses the weight of the furniture piece over a large contact area thereby reducing the weight per square inch of contact. This combination of a relatively large, smooth, contoured contact surface reduces wear and the force or thrust required to move furniture across a floor.

Another advantage of the invention is that the thick glide can be used with furniture placed on carpeted floors, since the glide raises the furniture off the floor, or on hard floors, such as wood, linoleum or a no-wax floor or concrete, since the glide is rigid and lubric.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

Figure 5:
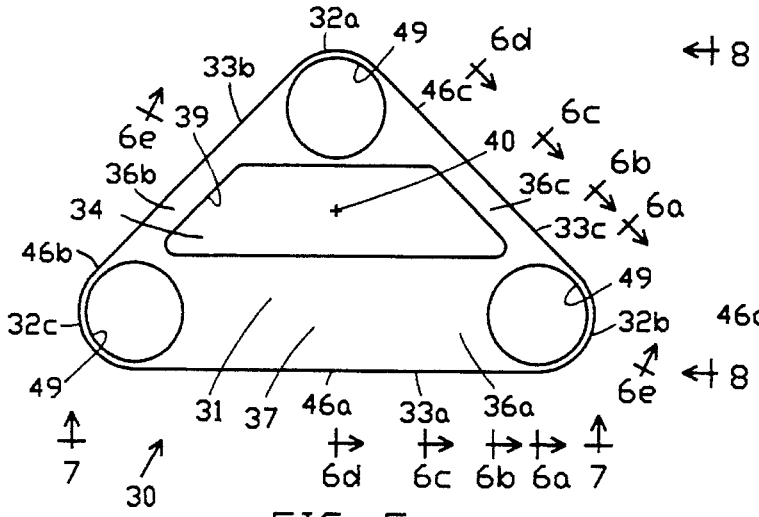
FIG. 5 is a top elevational view of a glide constructed in accordance with the present invention.
Figure 7:
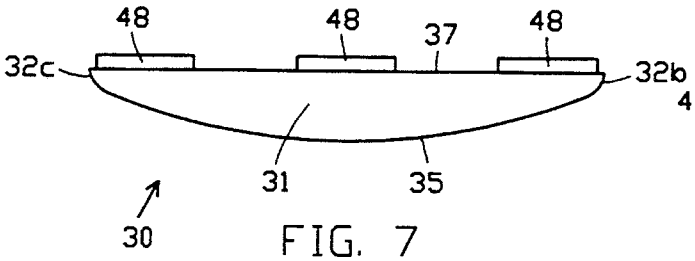
Figure 8:
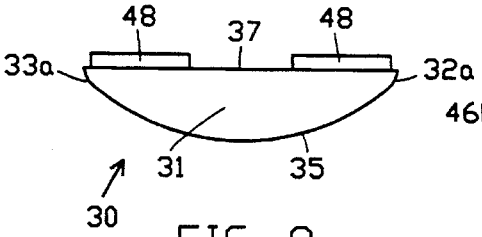
Figure 6E:
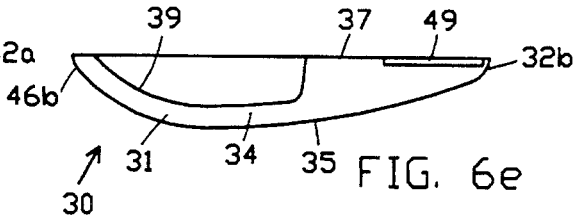
Figure 9:
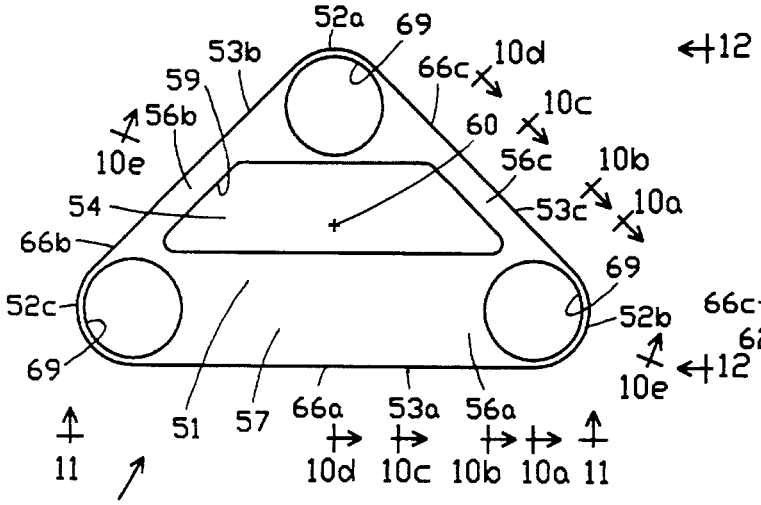
Figure 10A:
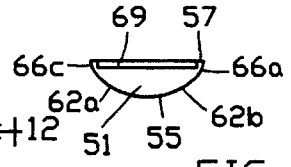
Figure 10B:
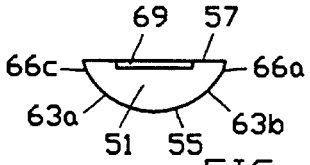
Figure 11:
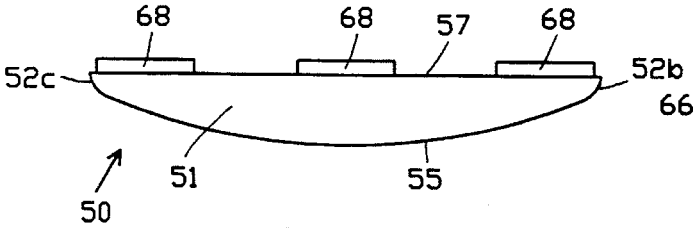
Figure 10C:
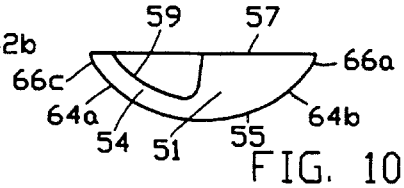
Figure 10D:
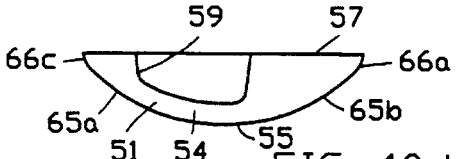
Figure 12:
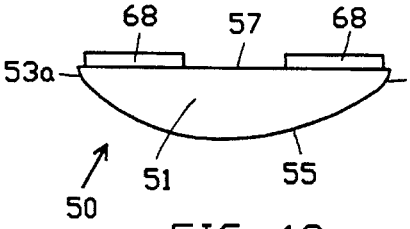
Figure 10E:
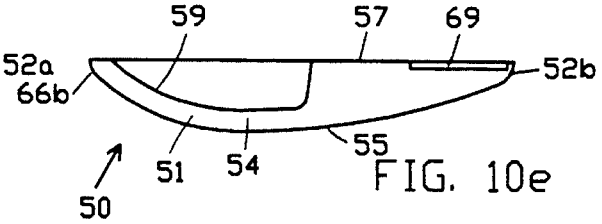
Figure 13:
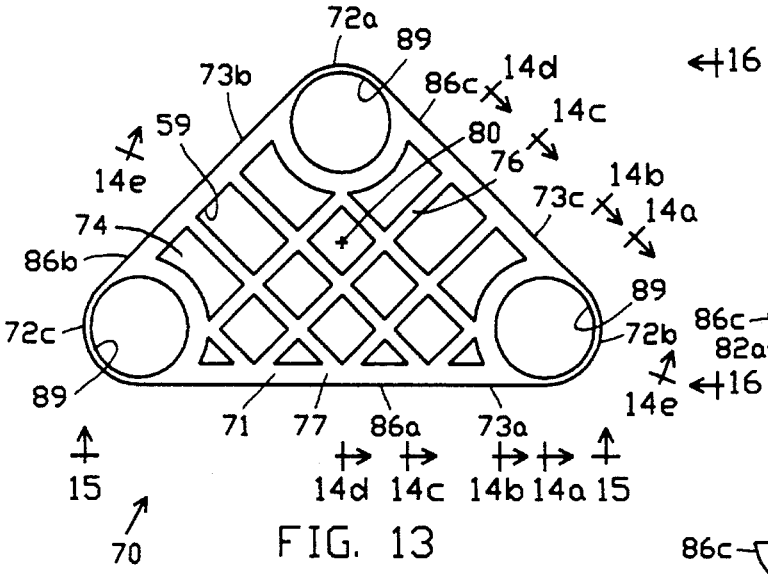
Figure 14A:
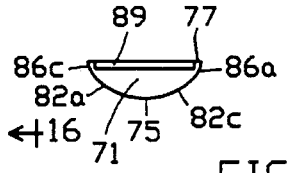
Figure 14B:
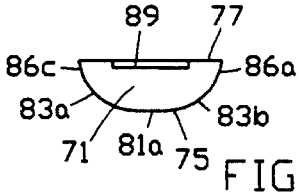
Figure 15:
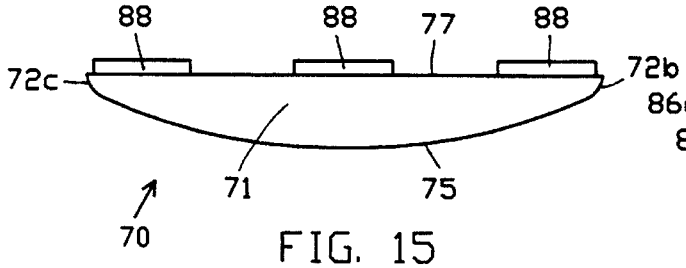
Figure 14C:
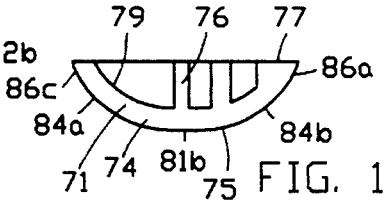
Figure 14D:
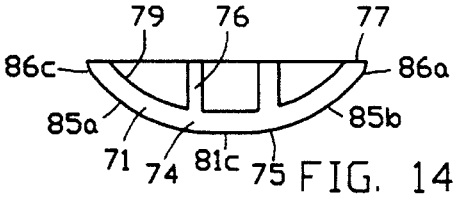
Figure 16:
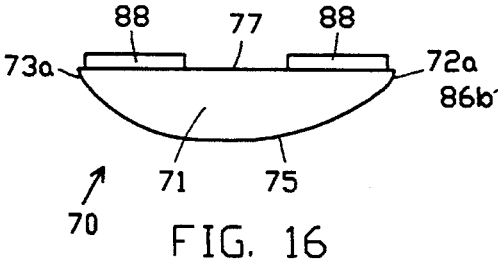
Figure 14E:
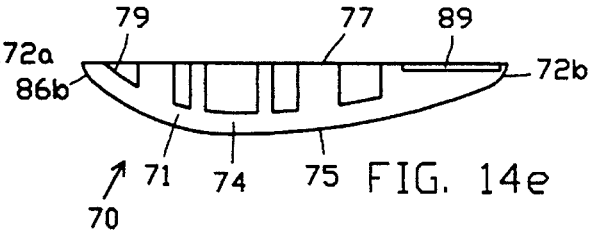

FIG. **6*a* is a cross-sectional view of the glide taken along line 6*a*—6*a* of FIG. 5**;

FIG. **6*b* is a cross-sectional view of the glide taken along line 6*b*—6*b* of FIG. 5**;

FIG. **6*c* is a cross-sectional view of the glide taken along line 6*c*—6*c* of FIG. 5**;

FIG. **6*d* is a cross-sectional view of the glide taken along line 6*d*—6*d* of FIG. 5**;

FIG. **6*e* is a cross-sectional view of the glide taken along line 6*e*—6*e* of FIG. 5**;

FIG. 7 is a front elevational view of the glide taken along line 7—7 of FIG. 5 shown with the adhesive disks in place;

FIG. 8 is a side elevational view of the glide taken along line 8—8 of FIG. 5 shown with the adhesive disks in place;

FIG. 9 is a top elevational view of a second embodiment of a glide constructed in accordance with the present invention;

FIG. **10*a* is a cross-sectional view of the glide taken along line 10*a*—10*a* of FIG. 9**;

FIG. 10*b* is a cross-sectional view of the glide taken along line 10*b*—10*b* of FIG. 9;

FIG. 10*c* is a cross-sectional view of the glide taken along line 10*c*—10*c* of FIG. 9;

FIG. 10*d* is a cross-sectional view of the glide taken along line 10*d*—10*d* of FIG. 9;

FIG. 10*e* is a cross-sectional view of the glide taken along line 10*e*—10*e* of FIG. 9;

FIG. 11 is a front elevational view of the glide taken along line 11—11 of FIG. 9 shown with the adhesive disks in place;

FIG. 12 is a side elevational view of the glide taken along line 12—12 of FIG. 9 shown with the adhesive disks in place;

FIG. 13 is a top elevational view of a third embodiment of a glide constructed in accordance with the present invention;

FIG. 14*a* is a cross-sectional view of the glide taken along line 14*a*—14*a* of FIG. 13;

FIG. 14*b* is a cross-sectional view of the glide taken along line 14*b*—14*b* of FIG. 13;

FIG. 14*c* is a cross-sectional view of the glide taken along line 14*c*—14*c* of FIG. 13;

FIG. 14*d* is a cross-sectional view of the glide taken along line 14*d*—14*d* of FIG. 13;

FIG. 14*e* is a cross-sectional view of the glide taken along line 14*e*—14*e* of FIG. 13;

FIG. 15 is a front elevational view of the glide taken along line 15—15 of FIG. 13 shown with the adhesive disks in place; and, FIG. 16 is a side elevational view of the glide taken along line 16—16 of FIG. 13 shown with the adhesive disks in place.

DESCRIPTION OF THE PREFERRED EMBODIMENTS

Best Modes for Carrying Out the Invention

Figure 1:
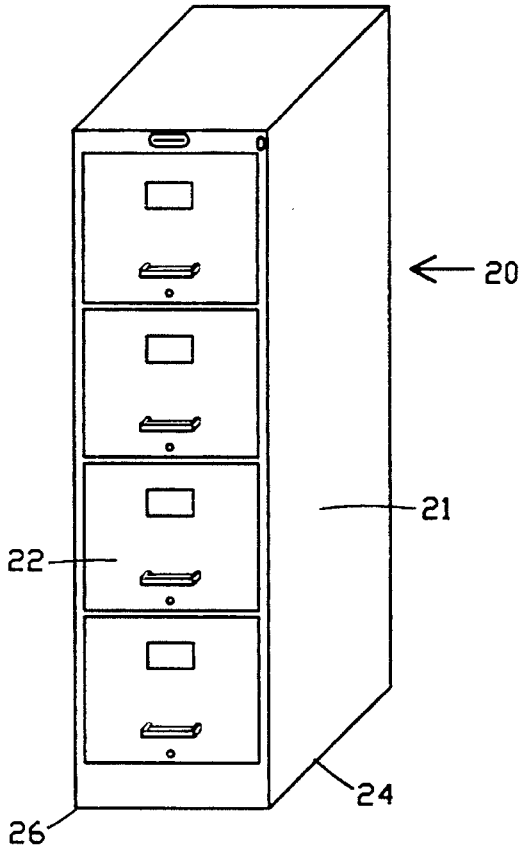
FIG. 1 is a front perspective view of a conventional file cabinet.
Figure 2:
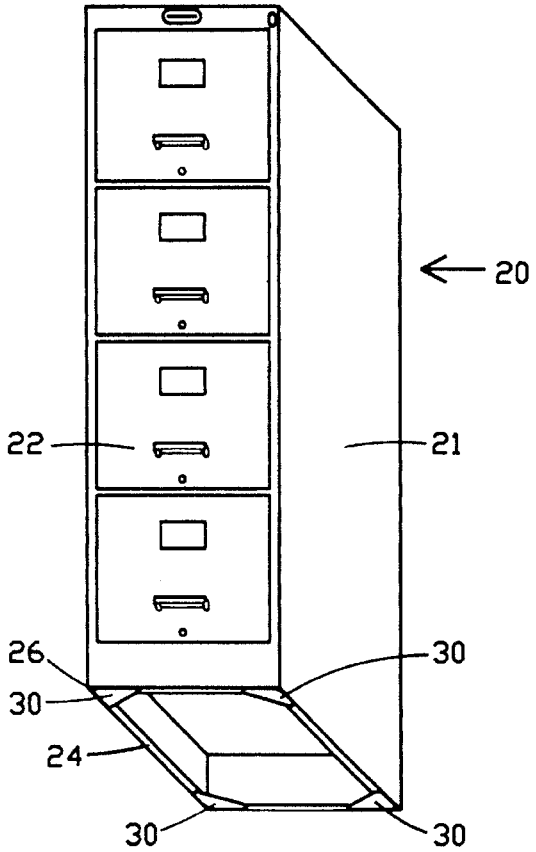
FIG. 2 is a bottom perspective view of the file cabinet showing the glides of the present invention in place at the four corners of the file cabinet.
Figure 3:
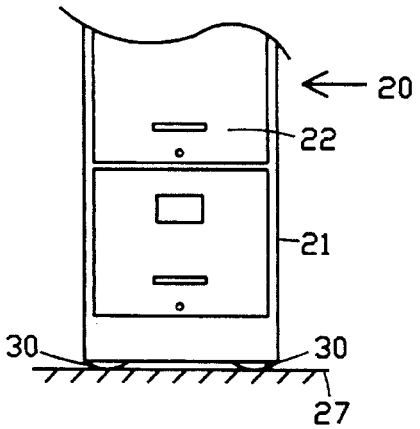
FIG. 3 is a partial front view of the file cabinet on the floor showing the glides of the present invention in place.
Figure 4:
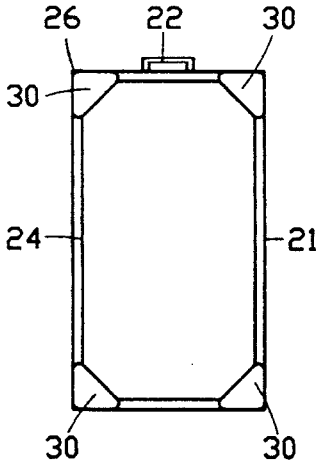
FIG. 4 is a bottom elevational view of the file cabinet showing the glides of the present invention in place at the four corners of the file cabinet.

Referring to FIG. 1 through 4 of the drawings, a conventional file cabinet, generally designated 20, is comprised of a front, back and side walls, collectively designated 21, supporting movable drawers 22. The lower ends of the walls 21 define the bottom 24 of the cabinet file 20. Attached to the bottom 24 of the walls 21 at each of the cabinet's four corners 26 are furniture floor glides, collectively designated 30. As seen in FIG. 3, the glides 30 are used to support the file cabinet 20 on a horizontal floor surface 27.

In an exemplary use, a series of four furniture glides 30 are attached respectively to the four bottom corners 26 of the file cabinet 20. The glides 30 may be attached to other items of furniture, such as tables, dressers, desks, bookcases, shelving, entertainment centers, china cabinets, appliances, electronic equipments, tool boxes and the like. Herein, the term "furniture" shall mean to include these items, but shall not be limited thereto. The utility and application of the glide to other pieces of furniture and items is similar.

The glide 30 shown in FIGS. 5 through 8 is basically a monobloc 31 triangular in shape, the monobloc having the general shape of a isosceles right triangle when viewed in horizontal cross section. The monobloc 31 has three non-colinear rounded or filleted corners 32*a*, 32*b* and 32*c*, collectively referred to as 32, with relatively linear peripheral edges 33*a*, 33*b* and 33*c*, collectively referred to as 33, extending between the corners 32.

For illustrative purposes, the dimensions of this exemplary monobloc 31 follow. Without rounded corners, i.e., with the peripheral straight edges 33 extended to their intersection, the monobloc 31 is formed from a piece of material in the shape of an isosceles right triangle 3.00 high, with a linear hypotenuse edge opposite the right angle corner 32*a* measuring 6.00 inches and two linear side edges measuring approximately 4.24 inches each. At its thickness point, the monobloc 31 is approximately 0.62 inch thick. In the embodiments shown, the corners 32 of the monobloc 31, where adjacent edges intersect, are filleted with a curve having a radius of 0.50 inch. With rounded corners the finished monobloc 31 is approximately 4.59 inches long and 2.79 inches wide. The size and configuration of the monobloc 31 may be changed as necessary or desirable for specific applications.

The monobloc 31 is integrally formed as a single piece and may be injection molded, milled or otherwise formed from thermoplastic, such as co-polyester, high-density and ultrahigh density polyethylene or polypropylene, or any other material or composite or laminate having low friction qualities and being relatively hard, yet soft and resilient to minimize the possibility of cracking or breakage.

The monobloc 31 has a bottom wall 34 defining a floor-contacting lower surface 35 and a structural web or rib 36 extending from the bottom wall 34 to its upper surface 37 distal from the bottom wall. The web 36 has segments 36*a*, 36*b* and 36*c* extending laterally between the respective corners 32*a*, 32*b* and 32*c* to define corner block segments (not numbered). The upper surface 37 of the monobloc 31 is adapted for mounting adjacent the bottom surface 24 of the cabinet 20. The upper surface 37 of the monobloc 31 will support the cabinet 20. In the case of the file cabinet 20 formed from sheet metal shown in FIGS. 1 through 4, the cabinet 20 usually has narrow bottom edges 24 formed by bending the metal sides of the cabinet inward and then optionally upward to define a horizontal rim approximately ½ to ¾ inch wide. The glide 30 is placed on the rim aligned with the outer walls 21 in the cabinet corners 26 and secured by adhesive described hereinafter.

The monobloc web 36 defines a cavity 39 below the upper surface 37, the depth of the cavity 39 leaving the bottom wall 34 with a thickness of approximately 0.19 inch, but depending on the material and use the thickness may vary from 0.12 to 0.25 inch or more at the bottom. The cavity 39 enables the manufacturer thereof to reduce material use. However, the strength of the monobloc 31 is not unduly lessened, since the structural web segments 36*a*, 36*b* and 36*c* approximately 0.25 inch wide and 1.00 inch wide extend between the respective lower and upper surfaces 35 and 37 and laterally between the corners 32 to resist deformation and minimize crushing or bending of the monobloc 31 when in use.

The lower surface 35 of the monobloc 31 is arcuate over its entire extent. The floor-contacting lower surface 35 is convex downwardly away from the monobloc upper surface 37. In FIG. 5, a number of cross-sections are taken and are shown in FIGS. 6*a*, 6*b*, 6*c*, 6*d* and 6*e*. The lowest point on the glide 30 lies at the midpoint indicated at 40 of the altitude line extending between the right-angle corner 32*a* and the spanning edge 33*a*.

Figure 6A:
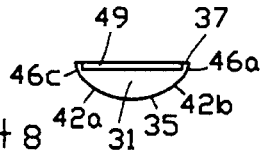
Figure 6B:
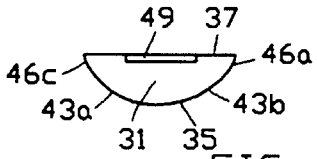
Figure 6C:
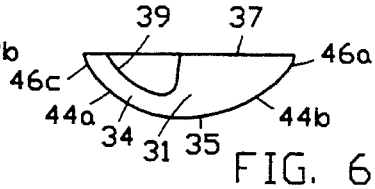
Figure 6D:
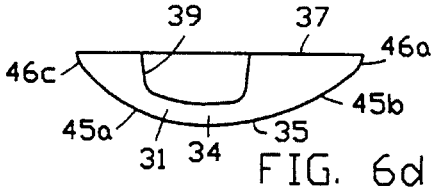

As seen in the cross-sections of FIGS. 6*a*, 6*b*, 6*c* and 6*d*, curves defining the lower surface 35 vary from a relatively small diameter arc near the corner as illustrated in FIG. 6*a* to a relatively large diameter arc near the center point 40 as illustrated in FIG. 6*d*. By way of example, the arcs 42*a* and 42*b* in FIG. 6*a* both have radii of approximately 0.62 inch; the arcs 43*a* and 43*b* in FIG. 6*b* have radii of approximately 0.71 and 0.81 inch, respectively; the arcs 44*a* and 44*b* in FIG. 6*c* have radii of approximately 0.95 and 1.24 inches, respectively; the arcs 45*a* and 45*b* in FIG. 6*d* have radii of approximately 1.42 and 2.08 inches, respectively.

At the sides, small curves 46*a*, 46*b* and 46*c* having a radius of 0.25 inch extend from the large curves to the edges 33 where a draft angle of 7 degrees is maintained to facilitate removal from a mold should be monobloc 31 be formed by injection molding. The size of the small radius and the draft angle may be varied as desired. For example, draft angles between 3 and 10 degrees have been found suitable for injection molded parts.

As will be shown later, the size of the arcs may be varied as required, but should blend into one another and into the edges so that no sharp edges are presented to the floor or the carpet pile which may be present thereon. The blended arcs together define the bottom and sides of the monobloc 31 and, hence, the relatively smooth arcuate floor-contacting contacting surface 35.

The thickest part of the glide 30 lies within the center section of the monobloc at 40. The lowermost surface 35 of the bottom wall 34 is spaced away from the long peripheral edge 33*a* towards the right-angle corner 32*a*. Thus, the weight of the file cabinet 20 is positioned more closely over the floor-contacting surface portion of the lower surface 35, which in turn, minimizes the effect of the file cabinet's weight tending to tilt or bend the glide 30. Adhesive disks, collectively designated 48, shown in FIGS. 7 and 8, approximately ⅞ inch in diameter and 3/16 inch thick are carried within recesses, collectively designated 49, ⅞ inch in diameter and 1/16 inch deep defined in the upper surface 37 of the monobloc corner blocks adjacent each corner 32. Cross-linked polyethylene foam having a density of approximately 3 lb/ft$^3$ having an adhesive coating applied to both flat sides is suitable in this application. The adhesive disks 48 may have different thickness and be made of one or more layers of any resilient type material, including plastic foam, felt or rubber or layers of such materials, coated on both sides with suitable adhesive or glue. During manufacture, the lower side of the adhesive disks 48 may be secured to the monobloc 31 with the upper side of the adhesive disk 48 covered by a removable plastic or waxed backing paper (not shown), which is peeled away from the disk 48 prior to application of the monobloc 31 to the cabinet 20. When the glide 30 is secured to the cabinet 20, the adhesive disks 48 bond the monobloc 31 to the cabinet 20. When the weight of the cabinet 20 is placed on the monobloc 31, the adhesive disks 48 are pressed into their respective recesses 49, but the weight of the cabinet 20 is supported on the upper surface 37 of the monobloc 31, not on the adhesive foam. The adhesive disks 48 though compressed secure the monobloc 31 to the cabinet bottom thereby preventing the cabinet 20 from moving off the glide 30 as the cabinet 20 is moved along the floor 27.

In use, the perpendicular edges 33*b* and 33*c* of the glide 30 are aligned with the square side corners 26 of the cabinet 20 and then pressed against the bottom 24 of the cabinet 20 with the exposed adhesive securing the glide 30 to the cabinet 20. The upper surface 37 of the glide 30 is in contact with the bottom surface 24 of the cabinet 20, the glide 30 raising the cabinet off the floor surface 27. The curved surface 35 presents a limited surface area thereby reducing sliding friction. The curved surface 35 also allows carpeting and the like to bend under the glide 30 so that the glide 30 can travel up the carpet pile rather than catching the pile to prevent travel. Since the glide 30 is formed from a low friction lubric-type material facilitating sliding between the glide 30 and the floor surface 27, the cabinet 20 can be slid easily along the floor with a minimum of effort.

The glide 50 shown in FIGS. 9 through 12 is similar to the glide 30 shown in FIGS. 5 through 8 and is basically a monobloc 51 triangular in shape, the monobloc having the general shape of a isosceles right triangle when viewed in horizontal cross section. The monobloc 51 has three non-colinear rounded or filleted corners 52*a*, 52*b* and 52*c*, collectively referred to as 52, with relatively linear peripheral edges 53*a*, 53*b* and 53*c*, collectively referred to as 53, extending between the corners 52. The dimensions are similar to those given for monobloc 31. The monobloc 51 is integrally formed as a single piece and may be injection molded, milled or otherwise formed from thermoplastic.

The monobloc 51 has a bottom wall 54 defining a floor-contacting lower surface 55 and a structural web or rib 56 extending from the bottom wall 54 to its upper surface 57 distal from the bottom wall. The web 56 has segments 56*a*, 56*b* and 56*c* extending laterally between the respective corners 52*a*, 52*b* and 52*c* to define corner block segments (not numbered). The upper surface 57 of the monobloc 51 is adapted for mounting adjacent the bottom surface 24 of the cabinet 20 which it will support.

The monobloc web 56 defines a cavity 59 below the upper surface 57, the depth of the cavity 59 leaving the bottom wall 54 with a thickness of approximately 0.19 inch, but depending on the material and use the thickness may vary from 0.12 to 0.25 or more at the bottom.

The lower surface 55 of the monobloc 51 is arcuate over its entire extent. The floor-contacting lower surface 55 is convex downwardly away from the monobloc upper surface 57. In FIG. 9, a number of cross-sections are taken and are shown in FIGS. 10*a*, 10*b*, 10*c*, 10*d* and 10*e*. The lowest point on the glide shown here lies at the intersection of the corner angle bisecting lines indicated at 60 extending between the respective corners 52*a*, 52*b*, and 52*c* and the edges 53*a*, 53*b* and 53*c*.

As seen in the cross-sections of FIGS. 10*a*, 10*b*, 10*c* and 10*d*, curves defining the lower surface 55 vary from a relatively small diameter arc near the corner as illustrated in FIG. 10*a* to a relatively large diameter arc near the center point 60 as illustrated in FIG. 10*d*. Here, each pair of arcs taken across the cross section are similar, since the defining arcs extend from a bisecting line. By way of example, the arcs 62*a* and 62*b* in FIG. 10*a* both have radii of approximately 0.61 inch; the arcs 63*a* and 63*b* in FIG. 10*b* both have radii of approximately 0.68 inch; the arcs 64*a* and 64*b* in FIG. 10*c* both have radii of approximately 1.19 inches; the arcs 65*a* and 65*b* in FIG. 10d both have radii of approximately 1.67 inches.

At the sides, small curves 66*a*, 66*b* and 66*c* having a radius of 0.25 inch extend from the large curves to the edges 53 where a draft angle of 7 degrees is maintained to facilitate removal from a mold should be monobloc 51 be formed by injection molding.

The thickest part of the glide lies within the center section of the monobloc at 60. The lowermost surface 55 of the bottom wall 54 is spaced away from the long peripheral edge 53*a* towards the right-angle corner 52*a*.

Adhesive disks, collectively designated 68, shown in FIGS. 11 and 12, approximately ⅞ inch in diameter and 3/16 inch thick are carried within recesses, collectively designated 69, ⅞ inch in diameter and 1/16 inch deep defined in the upper surface 57 of the monobloc corner blocks adjacent each corner 52.

In use, the perpendicular edges 53*b* and 53*c* of the glide 50 are aligned with the square side corners of the cabinet and then pressed against the bottom of the cabinet with the exposed adhesive securing the glide to the cabinet. The upper surface 57 of the glide is in contact with the bottom surface of the cabinet, the glide raising the cabinet off the floor surface.

The glide 70 shown in FIGS. 13 through 16 is similar to the glide 30 shown in FIGS. 5 through 8 and is basically a monobloc 71 triangular in shape, the monobloc having the general shape of a isosceles right triangle when viewed in horizontal cross section. The monobloc 71 has three noncolinear rounded or filleted corners 72*a*, 72*b* and 72*c*, collectively referred to as 72, with relatively linear peripheral edges 73*a*, 73*b* and 73*c*, collectively referred to as 73, extending between the corners 72. The dimensions are similar to those given for monobloc 31. The monobloc 71 is integrally formed as a single piece and may be injection molded, milled or otherwise formed from thermoplastic.

The monobloc 71 has a bottom wall 74 defining a floor-contacting lower surface 75 and a series of interconnected structural webs or ribs 76 extending from the bottom wall 74 to its upper surface 77 distal from the bottom wall. The web 76 has segments measuring ⅛ to ¼ inches wide and extending laterally between the respective corners 72*a*, 72*b* and 72*c* to define corner block segments (not numbered). The upper surface 77 of the monobloc 71 is adapted for mounting adjacent the bottom surface 24 of the cabinet 20 which it will support.

The monobloc webs 76 define multiple cavities 79 below the upper surface 77, the depth of the cavities 79 leaving the bottom wall 74 with a thickness of approximately 0.19 inch, but depending on the material and use the thickness may vary from 0.12 to 0.25 or more at the bottom. This embodiment is advantageous with injection molded parts since all walls and edges and surfaces are of similar thickness and weight permitting all of the elements of the monobloc to cool at similar rates to minimize unusual shrinkage problems.

The lower surface 75 of the monobloc 71 is arcuate over most of its entire extent. The floor-contacting lower surface 75 is convex downwardly away from the monobloc upper surface 77. In FIG. 13, a number of cross-sections are taken and are shown in FIGS. 14*a*, 14*b*, 14*c*, 14*d* and 14*e*. The lowest point on the glide shown here lies at the intersection of the corner angle bisecting lines indicated at 80 extending between the respective corners 72*a*, 72*b*, and 72*c* and the edges 73*a*, 73*b* and 73*c*. Short flat surface sections designated 81*a*, 81*b*, and 81*c* approximately ¼ inch wide are provided on the lower floor contacting surface 75.

As seen in the cross-sections of FIGS. 14*a*, 14*b*, 14*c* and 14*d*, curves defining the lower surface 75 vary from a relatively small diameter arc near the corner as illustrated in FIG. 14*a* to a relatively large diameter arc near the center point 80 as illustrated in FIG. 14*d*. Here, each pair of arcs taken across the cross section are similar, since the defining arcs extend from a bisecting line. By way of example, the arcs 82*a* and 82*b* in FIG. 14*a* both have a radius of approximately 0.61 inch; the arcs 83*a* and 83*b* in FIG. 14*b* both have radii of approximately 0.51 inch; the arcs 84*a* and 84*b* in FIG. 14*c* both have radii of approximately 0.96 inch; the arcs 85*a* and 85*b* in FIG. 14*d* both have radii of approximately 1.38 inches.

At the sides, small curves 86*a*, 86*b* and 86*c* having a radius of 0.25 inch extend from the large curves to the edges 73 where a draft angle of 7 degrees is maintained to facilitate removal from a mold should be monobloc 71 be formed by injection molding.

The thickest part of the glide lies within the center section of the monobloc at 80. The lowermost surface 75 of the bottom wall 74 is spaced away from the long peripheral edge 73*a* towards the right-angle corner 72*a*.

Adhesive disks, collectively designated 88, shown in FIGS. 15 and 16, approximately ⅞ inch in diameter and 3/16 inch thick are carried within recesses, collectively designated 89, ⅞ inch in diameter and 1/16 inch deep defined in the upper surface 77 of the monobloc corner blocks adjacent each corner 72.

In use, the perpendicular edges 73*b* and 73*c* of the glide 70 are aligned with the square side corners of the cabinet and then pressed against the bottom of the cabinet with the exposed adhesive securing the glide to the cabinet. The upper surface 77 of the glide is in contact with the bottom surface of the cabinet, the glide raising the cabinet off the floor surface.

Industrial Applicability

From the foregoing, it should be apparent that the glides described herein are simple and inexpensive and provide a convenient and effective means for readily and easily moving and locating furniture on floors.

Other aspects, objects and advantages of this invention can be obtained from a study of the drawings, the disclosure and the appended claims.

What is claimed is:

1. A glide for supporting furniture on a substantially horizontal floor surface comprising:

a monobloc having a bottom wall and at least one structural web extending from said bottom wall, said bottom wall having a floor-contacting lower surface under said web defined in part by a series of arcs blended together to define a relatively smooth convex surface;

said web extending along the periphery of the monobloc and having an upper surface at the end distal from said bottom wall adapted to support furniture thereon, said distal end defining at least one recess; and, adhesive coated resilient material fixed within said recess, said adhesive material having an exposed upper side adapted to secure the monobloc to the bottom of furniture, whereby furniture on said monobloc rests on the upper surface thereof with the adhesive material holding the monobloc to the furniture pressed into said recess.

2. The glide of claim 1 wherein said monobloc is generally triangular in horizontal cross section, said monobloc having three noncolinear corners and linear peripheral edges extending respectively between said corners, two of said monobloc edges being perpendicular to each other, said perpendicular edges being alignable with the sides of the supported furniture, the lowest point on said monobloc lower surface being near the center of said monobloc spaced from said edges and corners.

3. The glide of claim 1 wherein said monobloc is generally triangular in horizontal cross section, said monobloc having three noncolinear corners and linear peripheral edges extending respectively between said corners, said web extending along said edges and into said corners and defining adhesive-receiving recesses adjacent each corner of said monobloc.

4. The glide of claim 3 wherein said structural web defines three peripheral segments and three corner blocks, one segment being located adjacent each peripheral edge and extending between adjacent corner block pairs, said corner blocks defining adhesive-receiving recesses adjacent each corner of the monobloc.

5. The glide of claim 1 wherein said adhesive material has an uncompressed thickness greater than the depth of said recess, whereby said adhesive material is pressed into said recess when furniture is supported on said monobloc.

6. The glide of claim 1 wherein said lower surface of the bottom wall is defined by a series of relatively large radius arcs, said peripheral web has an outer wall defined by a series of relatively small radius arcs, said large and small arcs defining the bottom and sides of said monobloc.

7. The glide of claim 6 wherein said small radius arcs have a radius less than 0.5 inch and define a draft angle between 3 and 10 degrees with said upper surface and said large radius arcs have a radius greater than 0.5 inch.

8. The glide of claim 1 wherein said monobloc is generally triangular in horizontal cross section, said monobloc having three noncolinear corners and linear peripheral edges extending respectively between said corners, said monobloc having a series of interconnecting web segments extending between said peripheral edges and said corners and defining adhesive-receiving recesses adjacent each corner of said monobloc, said webs defining a series of cavities therebetween extending from the bottom wall and said upper surface.

9. The glide of claim 1 wherein said monobloc is at least 0.5 inch thick.

10. The glide of claim 1 wherein said monobloc has a horizontal cross section similar to a right triangle with two peripheral edges being perpendicular to one another and alignable with the sides of the furniture supported thereon.

11. The glide of claim 1 wherein said monobloc is integrally formed from a thermoplastic material.

12. The glide of claim 1 wherein said resilient adhesive material is plastic foam coated on opposite sides with adhesive.

13. A glide for supporting furniture on a substantially horizontal floor surface comprising:

a generally triangularly-shaped monobloc integrally formed from thermoplastic at least 0.5 inch thick having an upper surface adapted to support furniture thereon and a floor-contacting lower surface defined in part by a series of arcs blended together to define a smooth relatively convex surface, said monobloc having three peripheral edges with adjacent edges extending respectively between noncolinear corners;

resilient adhesive material fixed to and extending above said upper surface of said monobloc, said adhesive material having an exposed upper side adapted to secure the monobloc to the bottom of furniture, whereby furniture on said monobloc rests on the upper surface thereof with the adhesive material holding said monobloc to the furniture.

14. The glide of claim 13 wherein two of said monobloc edges are perpendicular to each other, said perpendicular edges being alignable with the sides of the supported furniture.

15. The glide of claim 14 wherein said lower surface of the monobloc is defined by a series of relatively large radius arcs, and said edges are defined by a series of relatively small radius arcs, said large and small arcs defining the bottom and sides of said monobloc.

16. The glide of claim 13 wherein said monobloc has recesses defined adjacent each corner below said upper surface, and said resilient adhesive material is fixed in each of said recesses and extends above said upper surface of said monobloc.

17. A glide for supporting furniture on a substantially horizontal floor surface comprising:

a monobloc integrally formed from thermoplastic having an upper surface and a lower surface, said monobloc being at least 0.5 inch thick and generally triangular in horizontal cross section, said monobloc having three noncolinear filleted corners with a relatively linear peripheral edge extending between said corners, two of said edges being perpendicular to one another and being alignable with the sides of the supported furniture;

said upper surface being adapted for mounting in contact with the bottom surface of the furniture;

said monobloc including a bottom wall with said lower surface on the underside thereof, said lower surface being defined in part by a series of arcs blended together to define a relatively smooth arcuate floor-contacting surface convex away from said upper surface;

said monobloc defining at least one cavity therewithin below said upper surface, said cavity defining a series of structural webs extending between said upper and lower surfaces and laterally between said corners;

said monobloc having recesses defined adjacent each corner below said upper surface; and, resilient adhesive means fixed within each recess and extending above said upper surface for securing the monobloc to furniture, whereby furniture rests on the upper surface of the monobloc with the adhesive means holding said monobloc to the furniture pressed into said recesses.

18. The glide of claim 17 wherein the lowest point on said monobloc lower surface is near the center of said monobloc spaced from said edges and corners.

* * * * *